United States Patent [19]

Cantella

[11] 4,418,595

[45] Dec. 6, 1983

[54] AUTOMATIC HOLLOW PUNCH SEARCH METHOD FOR DIE-CUTTING MACHINES, PARTICULARLY FOR FOOTWEAR PRODUCTION

[75] Inventor: Emiliano Cantella, Vigevano, Italy

[73] Assignee: Atom S.p.A., Vigevano, Italy

[21] Appl. No.: 384,330

[22] Filed: Jun. 2, 1982

Related U.S. Application Data

[62] Division of Ser. No. 140,087, Apr. 14, 1980, Pat. No. 4,363,253.

[30] Foreign Application Priority Data

Apr. 27, 1979 [IT] Italy ..... 22220 A/79

[51] Int. Cl.[3] ..... B26D 3/00

[52] U.S. Cl. ..... 83/55; 83/371; 83/524; 83/534; 83/554

[58] Field of Search ..... 83/371, 524, 534–538, 83/541, 554, DIG. 1, 55

[56] References Cited

U.S. PATENT DOCUMENTS

| | | | |
|---|---|---|---|
| 3,204,506 | 9/1965 | Reinhold | 83/534 |
| 3,389,628 | 6/1968 | Banks et al. | 83/534 |
| 3,402,626 | 9/1968 | Banks | 83/534 |
| 3,533,322 | 10/1970 | Offenstadt | 83/534 |
| 3,575,077 | 4/1971 | Herdeg | 83/524 |
| 3,905,265 | 9/1975 | Peterson et al. | 83/537 |
| 4,001,645 | 1/1977 | Haas et al. | 83/541 |

FOREIGN PATENT DOCUMENTS

| | | | |
|---|---|---|---|
| 2011827 | 7/1979 | United Kingdom | 83/371 |

*Primary Examiner*—E. R. Kazenske
*Assistant Examiner*—Willmon Fridie, Jr.
*Attorney, Agent, or Firm*—Browdy and Neimark

[57] ABSTRACT

Method for operating an automatic hollow punch search device and relevant control, for die-cutting machines, particularly for footwear production, in which a mobile head is associated to a device to move it to and fro, both horizontally and vertically, above a fixed faceplate on which the material to be cut is placed, together with a hollow cutting punch. The movement devices are automatically piloted by a drive circuit interlocked to manual starting device which provides means to carry out a complete head movement operating sequence from its positioning above the hollow punch to its lowering and return to the starting point after cutting.

5 Claims, 4 Drawing Figures

AUTOMATIC HOLLOW PUNCH SEARCH METHOD FOR DIE-CUTTING MACHINES, PARTICULARLY FOR FOOTWEAR PRODUCTION

REFERENCE TO RELATED APPLICATION

This is a division of co-pending application Ser. No. 140,087 filed Apr. 14, 1980, now issued as U.S. Pat. No. 4,363,253.

INTRODUCTION

This invention refers to a method for operating an automatic hollow punch device and relevant control, for die-cutting machines, particularly for footwear production, in which a mobile head is associated with means to move it vertically and horizontally to and fro, above a fixed faceplate on which the material to be cut is placed, a hollow cutting punch being laid above this material, to be pushed down, in the cutting phase, by said mobile head.

This invention is suitable both for flag type and bridge type die-cutting machines with mobile heads to cut material in any size sheet.

BACKGROUND OF THE INVENTION

In die-cutting machines presently in use, after the hollow punch is laid above the material to be cut, the mobile head is hand-positioned above said hollow punch, and the command is then given to lower the head for cutting. To facilitate the operator's task, in some die-cutting machines at present in use, the horizontal head movement is motorized, by push-button or similar means. Once again, however, head positioning above the hollow punch must be directly operator-controlled, as the operator intervenes and stops this head moving horizontally when it has reached the desired position. This operator then commands head lowering for cutting and then its lifting to carry out a successive operating cycle.

As can be seen, therefore, the die-cutting machines of known type require continuous operator attention, making this type of work particularly tiring. Also, head centering on the hollow punch is entrusted to the operator's experience and keen eye, which does not always lead to completely satisfactory results and, at any rate, involves the assistance of particularly expert operators.

BRIEF SUMMARY OF THE INVENTION

The main purpose of this invention is to eliminate the abovementioned drawbacks found in presently used systems, constructing an automatic hollow punch search method and relevant control, for a die-cutting machine, whose insures accurate working without the need for continuous operator assistance, the operator having only to arrange the hollow punches above the material to be cut and give the starting command. In this way, the die-cutting machine may be operated by non-specialized operators, which obviously yields a considerable reduction in production costs.

Another important purpose of this invention is to provide a method to operate an automatic device for die-cutting machines, operating safely and accurately, to guarantee regular cutting even while working time is reduced to a minimum.

These and further purposes, which may appear clear from the following description, are achieved by the method of the invention, where a mobile head is associated with means to move it horizontally and vertically to and fro, above a fixed faceplate on which the material to be cut is laid, the hollow cutting punch resting above this material, to be pushed down, in the cutting phase, by said mobile head. This control device is characterized by the fact that said movement means are piloted automatically by a drive circuit interlocked to the manual starting means, this drive circuit providing means to produce a complete head movement operating sequence, from its position above the hollow punch to lowering and subsequent return to the starting point after cutting. Said circuit comprises a sensitive element assembled on said head for automatic searching for the position of said hollow cutting punch laid on the material to be cut, and then stops the horizontal head movement automatically, when, in the initial phase of said operating sequence, it comes to rest above said hollow punch, in cutting position.

According to a further feature of this invention, the above-mentioned sensitive element is composed of an inductive surface switch, prearranged on one side of said head and cooperating with said hollow punch to stop horizontal head movement automatically and to subsequently lower the head after said inductive surface switch has passed over said hollow punch.

In order to always have the head centered on different sizes of hollow punches, according to a further invention feature, said drive circuit comprises an adjustable timer element connected to said inductive surface switch to delay stopping of the horizontal head movement and its subsequent downstroke, when said hollow punch laid on the material to be cut is relatively small.

BRIEF DESCRIPTION OF THE DRAWINGS

Further features of this invention will be seen in the detailed description of a preferred but non-exclusive embodiment of an automatic hollow punch search device and relevant control, for die-cutting flag type machines, illustrated purely by way of example and not by way of limitation in the attached drawing, in which.

DETAILED DESCRIPTION

In these figures, number 1 indicates a flag type die-cutting machine, provided with an automatic search device to perform the method of the invention.

The invention can also be applied to any other type of die-cutting machine, e.g. the bridge type with mobile head.

Figure 1:
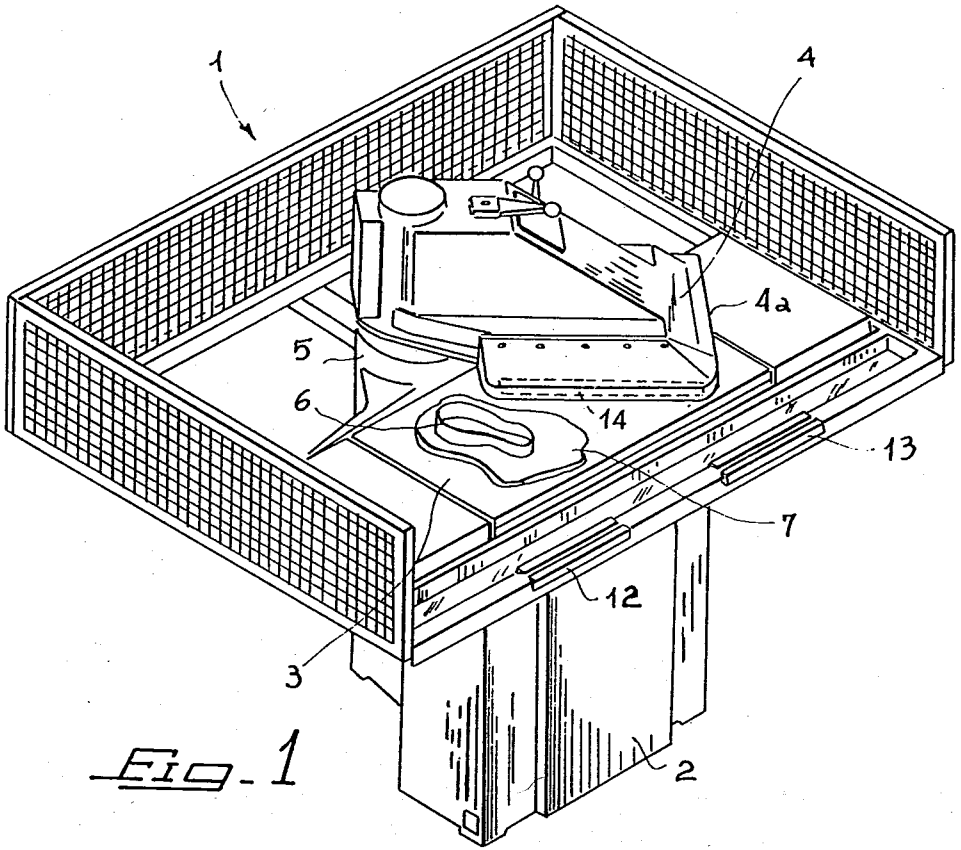
FIG. 1 is a perspective view of a die-cutting machine for carrying out the method of the invention.
Figure 2:
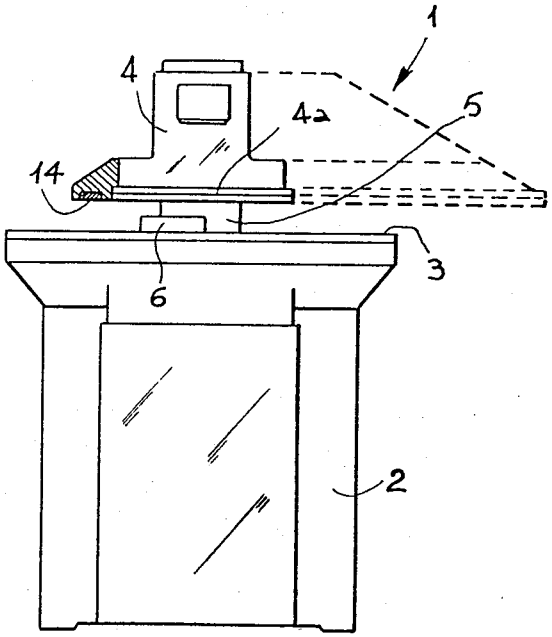
FIG. 2 is a partial cutaway side view of the same die-cutting machine.

As shown in detail in FIGS. 1 and 2, the die-cutting machine in the example includes a base 2, the top of which constitutes a fixed horizontal faceplate 3, above which a flag-assembled mobile head 4 is prearranged, on an upright 5 having a vertical axis.

At the foot of the head 4 is a horizontal plate, parallel to faceplate 3 and suitable, in cutting position, to push down a hollow steel cutting punch 6, laid on the sheet material 7 to be cut (FIG. 7), this material 7 being in turn arranged on the faceplate 3.

Figure 3:
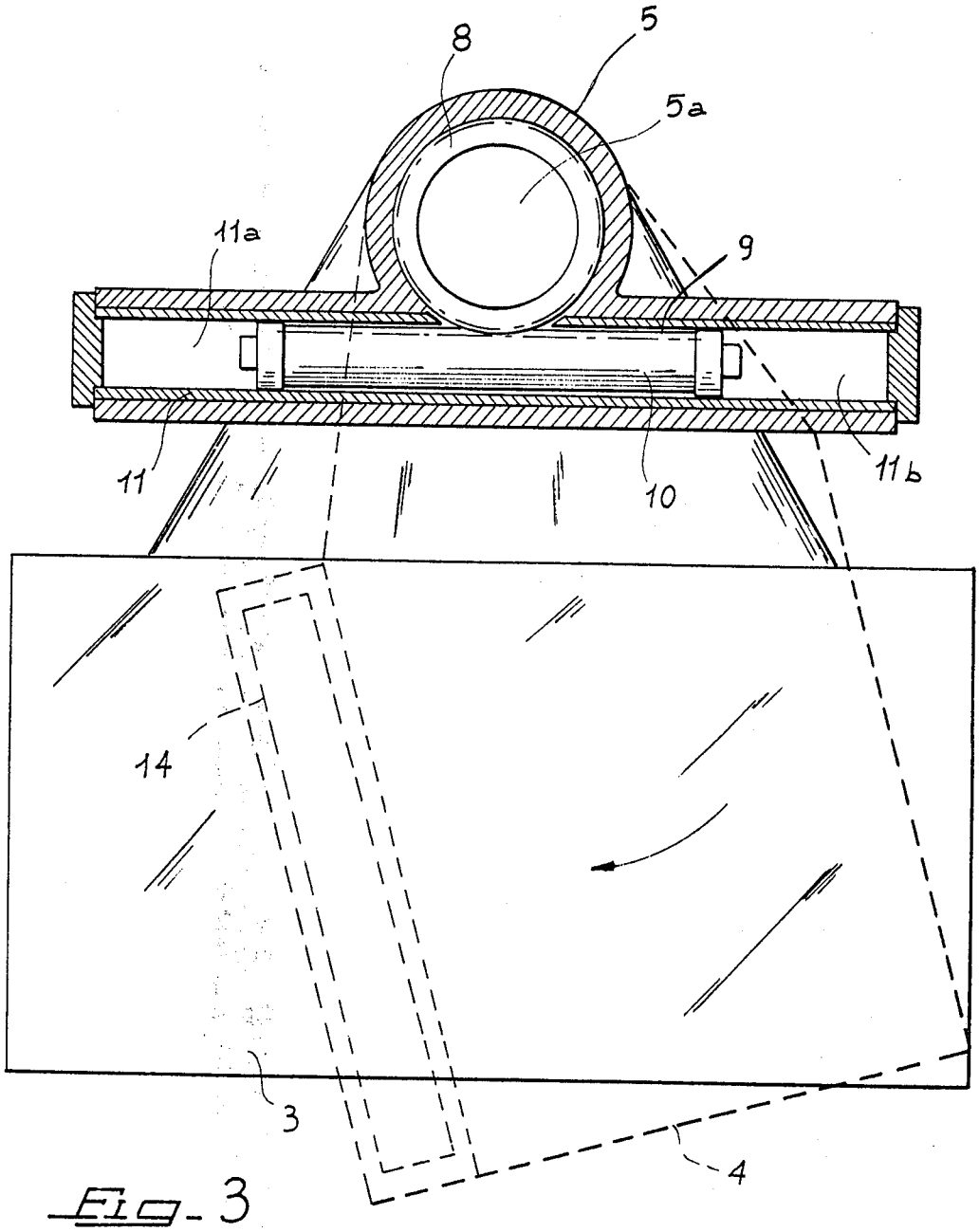
FIG. 3 is a horizontal cross section of the machine head movement unit.

The head 4 may be horizontally and vertically moved to and fro, i.e. vertically, with lifting and lowering movements along the axis of the vertical upright 5, obtained by known control means (not shown), e.g. fluid dynamics. Horizontally, the head 4 may be angularly moved around the axis of the upright 5 by means of the mechanism shown in FIG. 3. This mechanism comprises a gear wheel 8 mounted on a vertical axis, keyed on vertical column 5, sliding axially within the upright 5 and supporting the head 4. A rack 9 is engaged with the gear wheel 8, mounted in a piston 10 on a horizontal axis, and sliding in a respective horizontal hydraulic cylinder 11. This cylinder defines, from one side of piston 10 and the other, two chambers 11*a* and 11*b*, connected alternatively to a pressurized oil feed and drain, now shown, to angularly move the head 4 via the rack 9 and gear wheel 8.

Naturally, an equivalent mechanism may be provided in place of that shown in FIG. 1, composed, for example, of an electric motor and a suitable linkage, or the like.

It is also anticipated that, in rest conditions, the head 4 can be in a side position, e.g. to the right in the figures, as shown by the solid and dashed lines in FIG. 2. In this position, the head 4 is also lifted a certain height (adjustable) from the faceplate 3.

In the operating cycle, the head 4 rotates clockwise around the axis of column 5 in continuous sequence, starting from the abovementioned rest position, until said head is above the hollow punch 6, after which the horizontal head movement stops and head 4 lowering starts for cutting. The head is then relifted on wheels, in the counter-clockwise direction, to reach its initial position and stop. This operational sequence is automatic and operator assistance is only required to start the cycle, as explained below.

Figure 4:
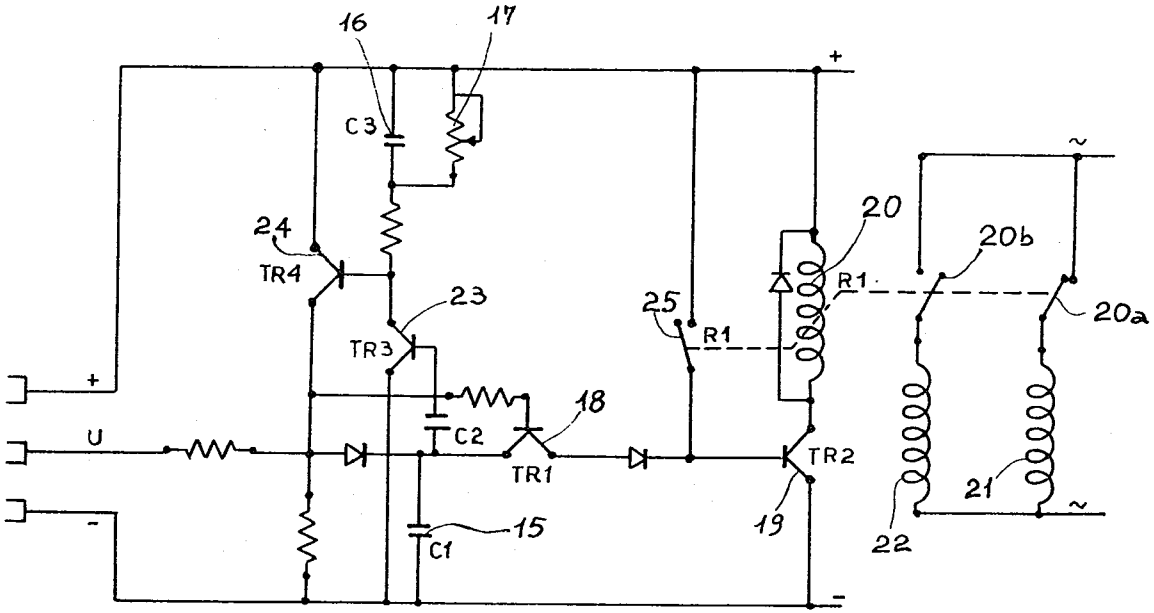
FIG. 4 is a schematic diagram of the electronic control circuit.

Starting control of the operating cycle is carried out by the operator placing both hands on two sensitive control plates 12 and 13 provided, with a certain space between them, in the front part of the machine near the faceplate 3 (FIG. 1). This operation, for which the operator must use both hands for safety reasons, activates the drive circuit illustrated in FIG. 4.

Means are provided to automatically search for the hollow punch 6 and to stop horizontal movement of the head 4 thereat. In this end an inductive bar surface switch is (often called simply "bar" herein) is provided, prearranged near the side edge of the head 4. The bar 14 is located on the lower surface of the plate 4*a* to detect the presence of the hollow metal punch 6, when it passes above it, later emitting a signal which is handled by the circuit in FIG. 4. This signal persists for the entire length of time in which the bar 14 remains superimposed on hollow punch 6 and stops when said bar passes over the hollow punch.

While the abovementioned signal is being emitted by the bar 14, two condensors 15 and 16 (FIG. 4) are simultaneously charged. The discharge time of the condensor 15 is determined by the features of said condensor, while the discharge time of the condensor 16 may be adjusted and extended as desired by means of a "trimer" timer 17.

When a relatively large hollow punch is placed on the work level, the signal emitted by the bar switch 14 is extended while the head moves horizontally, since a fairly long amount of time is required for the bar to pass over the relatively large hollow punch; when the signal stops, i.e. when the bar has passed over the hollow punch, the condensor 15 discharges and the power transistor 19 is made conductive through transistor 18. This causes consequent pickup, and locking in by means of a contact 25, of the relay 20 which also operates the contacts 20*a* and 20*b*. In practice, the relay 20 is operated at the same moment at which the bar 14 passes the hollow punch. The normally closed contact 20*a* then opens (shown in FIG. 4), in which there is pickup of the solenoid valve 21, to make the head 4 rotate in the clockwise direction (operated by the mechanism in FIG. 3) to the opening position where the solenoid valve 21 pickup stops and the head 4 consequently stops rotating.

Since in the case considered a large hollow punch has been used (i.e. slightly narrower than the plate 4*a*), the head is suitably stopped when it is centered above the hollow punch.

When the contact 20*a* is opened, the normally open contact 20*b* is simultaneously closed, causing pickup of the solenoid valve 22 which controls head 4 lowering for cutting. At the end of this phase, an end of stroke switch (not illustrated) controls the return of the head to the lifted position and its subsequent counter-clockwise rotation until it comes to rest in the initial position (moved to the right).

The machine is thus preset to carry out a successive operating cycle which will start, similarly to what has been seen, as soon as the operator again places both hands on the two sensitive plates 12 and 13.

In the case of small or narrow hollow punches, the signal determined by the bar 14, while the head is moved horizontally, is brief, and therefore, in the absence of the condensor 16 and the "trimer" 17, the condensor would be discharged too soon, as the head 4 would be stopped and would descend as soon as the bar 14 has passed the hollow punch. Since, in the case in question, this is narrow, the head 4 would then be stopped in an off-center position to said hollow punch, thus making regular cutting impossible due to eccentric stress, which would determine an unfavorable head inclination.

With the presence of the condensor 16 and the "trimmer" timer 17, this problem is overcome, by suitably delaying stopping of the clockwise movement of the head 4. In fact, while the condensor 15 is discharged immediately after the bar 16 has passed the hollow punch, the condensor 16 remains charged for a certain time, depending on adjustment of the "trimer" 17, so that clockwise head rotation may continue. By suitably adjusting the "trimer" timer 17, in relation to the hollow punch size, the condensor 16 will be discharged when the head is centered above the hollow punch. During discharge, similarly to the above, the relay 20 will intervene to stop clockwise head rotation and down stroke for cutting. Immediately after cutting, as seen above, the head will be lifted and moved in the counter-clockwise direction until it reaches the rest position. The die-cutting machine is therefore ready for a successive operating cycle.

From the above the operation of the control device in the invention appears evident.

The operator has only to deposit the hollow punch chosen above the material 7 to be cut, prearranged on the faceplate 3, after which he can start the operating cycle by simply placing both hands on the sensitive plates 12 and 13. As seen above, the operating cycle is fully automatic and requires no operator attention. In fact, the head 4 is moved first in clockwise direction, searching for the hollow punch automatically and stopping when it is centered above said hollow punch, independently of the size of the latter. Immediately afterward, cutting is carried out, as the head is lowered and then lifted and returned towards its initial position, also automatically. When the head is in the side rest position, the operator can conveniently adjust the faceplate 3.

It should be noted that, when the operator raises his hands from the sensitive control plates 12 and 13, the machine stops automatically in its exact position at that moment. If the operator then replaces his hands on said plates, he will start the head 4 moving in the opposite direction, so that, when dealing with small hollow punches, the operator may also avoid the head making an entire forward and backward stroke, with a consequent reduction in operating time.

As is now evident, the device of the present invention insures almost complete automation of the cutting cycle, at least centering of the head above various sizes of hollow punches, considerably lightening the operator's task and guaranteeing top quality work products, even with non-specialized staff. Naturally, the invention is not limited to the type of structure described, but numerous modifications are possible within the invention.

For example, in the case of application to bridge type die-cutting machines, with a mobile trolley, it can be equipped on two opposite sides with two inductive bar switches, so that it can operate the hollow punch search automatically both in translation direction and the opposite direction.

I claim:

1. A method of operating a die-cutting machine particularly for cutting material for footwear, said machine being of the type which has a fixed faceplate on which the material to be cut is placed and a mobile head mounted for motion in a horizontal plane above substantially the entire surface area of said faceplate, said machine further being of the type that uses separate hollow punches of different sizes and shapes positioned by the operator on the material to be cut on said faceplate, the method which comprises the steps of moving said mobile head in said horizontal plane starting from a rest position to seek a hollow punch therebelow, sensing a hollow punch on said material with means on said head as said head is moved in said horizontal plane, moving said head in a continuous and automatic cycle of operation starting from said rest position, moving said head in said horizontal plane until said sensitive element senses a hollow punch, stopping the motion of said head in said horizontal plane after said sensitive element has sensed that it has passed over said hollow punch and that said mobile head is therefore positioned over said sensed hollow punch, moving said head down to said hollow punch and then back up to said horizontal plane in a vertical cutting stroke, and then returning said head to said rest position, said machine comprising electrical circuit means and providing a pair of condensers in said electrical circuit means, causing said sensitive element to generate a signal starting from the time it first senses a hollow punch positioned on said material to be cut until the time it passes over said sensed hollow punch, providing a relatively large capacity in one of said condensers and providing a relatively small capacity in the other of said condensers, positioning both of said condensers in parallel circuits within said circuit means, and arranging said condensers within said circuit means such that either one of said condensers, upon its discharging, will operate other means to cause said head to cease its motion in said horizontal plane and to commence its motion in said vertical cutting stroke, and the step of selectively adjusting the capacity of said condenser of relatively smaller capacity, whereby said large capacity capacitor will not discharge until said head has completely passed over punches of normal to larger than normal size, and whereby said adjusted capacity of said capacitor of relatively smaller capacity will cause stoppage of motion in the horizontal plane and initiation of a vertical cutting stroke when said sensitive element senses a punch of relatively small size.

2. The method of claim 1, and using an inductive surface switch arranged in bar form as said sensitive element, mounting said inductive bar switch on said mobile head such that said switch will sweep over substantially the entire surface of said face plate as said head is moved in said horizontal plane during said cycle of operation.

3. The method of claim 2, mounting said mobile head on a vertically disposed upright comprising part of said machine, wherein said step of moving said mobile head in said horizontal plane comprises rotating said head about the axis of said vertically disposed upright, using inductive switch means as said sensitive element, mounting said inductive switch means on the loading edge of said head as it rotates over said face plate, and utilizing circuit means comprising a portion of said machine to cause the rotation of said head over said face plate to stop only after said inductive switch means has passed over a said hollow punch positioned on the material to be cut located on said face plate.

4. The method of claim 1, said machine comprising circuit means including manual starting means, causing said circuit means to permit said cycle of continuous and automatic operation to continue only as long as said manual starting means are continuously manually operated, utilizing said circuit means to cause said automatic and continuous cycle of operation to stop whenever an operator ceases to operate said manual starting means and to thereafter cause said automatic cycle to proceed backwards from the point at which it was stopped by the operator releasing the manual starting means back to the rest position, whereby operating time of said mahcine can be reduced by reversing the cycle from any particular point back to the start rather than permit forward operation through the cycle whenever operating conditions indicate that such a reversal is more efficient.

5. The method of claim 1, said machine comprising manual starting means comprising a pair of spaced sensitive plates or the like, and the step of wiring said machine and said sensitive plates in such a manner that said manual starting means will start said cycle of operation only when the operator operates both of said plates or the like simultaneously.

* * * * *